US008829375B2

(12) United States Patent
Hogan et al.

(10) Patent No.: US 8,829,375 B2
(45) Date of Patent: Sep. 9, 2014

(54) LIGHTED PUSH BUTTON

(75) Inventors: Michael P. Hogan, Carmel, IN (US); David J. Hurlbert, Manitou Springs, CO (US)

(73) Assignee: Schlage Lock Company LLC, Indianapolis, IN (US)

( * ) Notice: Subject to any disclaimer, the term of this patent is extended or adjusted under 35 U.S.C. 154(b) by 183 days.

(21) Appl. No.: 13/469,154

(22) Filed: May 11, 2012

(65) Prior Publication Data

US 2012/0298493 A1 Nov. 29, 2012

Related U.S. Application Data

(60) Provisional application No. 61/489,042, filed on May 23, 2011.

(51) Int. Cl.

| | |
|---|---|
| ***H01H 9/00*** | (2006.01) |
| ***G05G 1/02*** | (2006.01) |
| ***H01H 13/83*** | (2006.01) |

(52) U.S. Cl.

CPC ..... *G05G 1/02* (2013.01); *H01H 2221/056* (2013.01); *H01H 2221/066* (2013.01); *H01H 2221/08* (2013.01); *H01H 13/83* (2013.01); *H01H 2219/0622* (2013.01)

USPC ..... 200/314

(58) Field of Classification Search

CPC ..... H01H 13/00; H01H 13/04; H01H 13/50; H01H 13/52; H01H 2013/00; H01H 2013/04; H01H 2013/50; H01H 2249/014; H01H 2219/036; H01H 2223/00

USPC ..... 200/534, 48 R, 48 P, 50.03, 440, 449, 200/453, 457, 459, 463, 467, 511, 520, 540, 200/572, 239, 248–250, 290, 293, 302.2, 200/318, 318.1, 321–324, 333, 341, 345

See application file for complete search history.

(56) References Cited

U.S. PATENT DOCUMENTS

| | | | | |
|---|---|---|---|---|
| 3,437,775 | A | 4/1969 | Piber | |
| 4,242,545 | A * | 12/1980 | Schweitzer | 200/5 R |

(Continued)

FOREIGN PATENT DOCUMENTS

| | | | |
|---|---|---|---|
| EP | 0858087 | A2 | 8/1998 |
| GB | 2242572 | A | 10/1991 |
| JP | 2006318905 | A | 11/2006 |
| WO | 8606872 | A1 | 11/1986 |

*Primary Examiner* — Edwin A. Leon

*Assistant Examiner* — Anthony R. Jimenez

(74) *Attorney, Agent, or Firm* — Michael Best & Friedrich LLP

(57) ABSTRACT

A lighted pushbutton assembly includes a carrier including an outer wall that defines an inner space and is continuous along a top surface of the carrier. A rib guide is formed as part of the outer wall and defines an opening extending through a bottom surface of the outer wall and including a first portion extending in a first direction and a second portion extending in a second direction that is non-parallel to the first direction. A pushbutton is shaped to fit substantially within the inner space and a rib is formed as part of the pushbutton and includes a first guide that extends in the first direction and the second guide that extends in the second direction. The first guide is engaged with the first portion and the second guide is engaged with the second portion to guide reciprocating movement of the pushbutton with respect to the carrier.

24 Claims, 4 Drawing Sheets

(56) References Cited

U.S. PATENT DOCUMENTS

| | | | | |
|---|---|---|---|---|
| 5,424,516 | A * | 6/1995 | Emmons | 200/344 |
| 5,434,377 | A | 7/1995 | Martin et al. | |
| 5,521,578 | A | 5/1996 | DelValle | |
| 5,821,490 | A | 10/1998 | Blossfeld | |
| 6,646,211 | B2 | 11/2003 | Taniuchi et al. | |
| 2007/0193867 | A1 | 8/2007 | Lorenzo Riera et al. | |
| 2008/0073190 | A1 | 3/2008 | Cove | |
| 2009/0050456 | A1 | 2/2009 | Kim et al. | |
| 2010/0147661 | A1 | 6/2010 | Takeda | |

* cited by examiner

LIGHTED PUSH BUTTON

RELATED APPLICATIONS

This application claims priority to co-pending U.S. Provisional Patent Application No. 61/489,042 filed on May 23, 2011, the entire content of which is incorporated herein by reference.

BACKGROUND

The present invention relates to a lighted push button. More particularly, the invention relates to a lighted push button that is includes a light guide.

Pushbuttons are often employed in control systems to operate various features of a device. In some systems it is desirable to illuminate the perimeter around the pushbutton. However, guide surfaces and other components can make this lighting inconsistent.

SUMMARY

In one embodiment, the invention provides a lighted pushbutton assembly configured to be lighted by a light source. The lighted pushbutton assembly includes a carrier including an outer wall that defines an inner space, the outer wall being continuous along a top surface of the carrier. A rib guide is formed as part of the outer wall. The rib guide defines an opening that extends through a bottom surface of the outer wall and includes a first portion that extends in a first direction and a second portion that extends in a second direction, the second direction being non-parallel to the first direction. A pushbutton is shaped to fit substantially within the inner space and a rib is formed as part of the pushbutton and includes a first guide that extends in the first direction and the second guide that extends in the second direction. The first guide is engaged with the first portion and the second guide is engaged with the second portion to guide reciprocating movement of the pushbutton with respect to the carrier.

In another construction, the invention provides a lighted pushbutton assembly configured to be lighted by a light source. The lighted pushbutton assembly includes a carrier including an outer wall having an outer portion formed from a substantially opaque material. The outer wall defines a bottom surface, an inner space and a rib guide that extends through a portion of the outer wall. A light guide is positioned within the outer portion and is formed from a substantially translucent material. The light guide defines a top surface that includes a substantially continuous perimeter and a plurality of gaps. The guide space is positioned within one of the plurality of gaps and a pushbutton is disposed within the inner space and has a pushbutton perimeter that is surrounded by the top surface of the light guide. The pushbutton and carrier are disposed above the light source such that light enters the light guide at the bottom surface and is emitted through the top surface and around the entire pushbutton perimeter.

In another construction, the invention provides a lighted pushbutton assembly configured to be lighted by a light source. The lighted pushbutton assembly includes a pushbutton including a top wall arranged to be pushed by a user, the top wall defining a pushbutton perimeter. A pushbutton wall is formed as part of the top wall and extends in a direction substantially normal to the top wall and around the pushbutton perimeter. The pushbutton wall defines a pushbutton exterior, a pushbutton interior, and a bottom surface. A rib is formed as part of the pushbutton wall and extends into the pushbutton exterior. The rib includes a first guide that extends from the pushbutton wall in a first direction and a second guide that extends from the first guide in a second direction that is not parallel to the first direction. A carrier includes an outer wall that defines an inner space sized to receive the pushbutton. The outer wall defines a rib guide arranged to receive the rib, the rib guide operable to guide movement of the pushbutton in a direction that is substantially parallel to the pushbutton wall while inhibiting movement in the first direction and the second direction.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
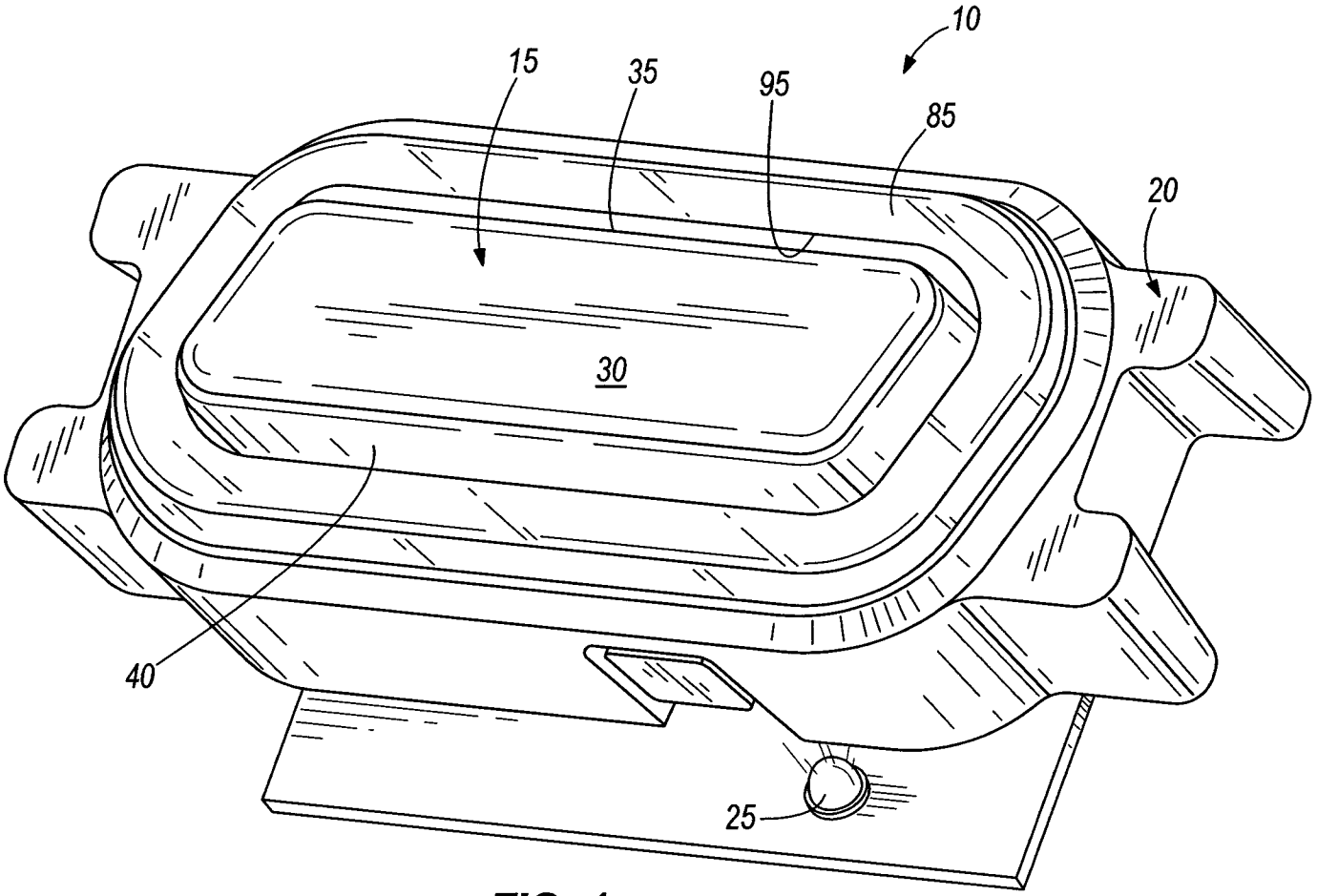
FIG. 1 is a perspective view of lighted pushbutton disposed within a carrier.

FIG. 1 illustrates a lighted pushbutton assembly 10 that includes a pushbutton 15 disposed within a carrier 20. A light source 25 is disposed beneath the pushbutton assembly 10 and is operable to light the assembly 10 as will be described. In preferred constructions, the light source 25 includes one or more LEDs positioned on a circuit board with other light sources 25 being possible. In the illustrated construction, the pushbutton 15 and the carrier 20 have a generally elongated parallelogram shape with rounded corners. One of ordinary skill in the art will realize that the invention described herein is applicable to pushbuttons 15 of various shapes including, but not limited to oval, circular, elliptical, rectangular, square, irregular and the like.

Before proceeding, it should be noted that the terms opaque, translucent, and transparent should be interpreted with respect only to the visible portion of the electromagnetic spectrum. Thus, a material that is opaque, is opaque with respect to visible light. The fact that an x-ray or other wavelength of light may pass through the material does not render the material transparent or translucent. Likewise, a material that allows for the transmission of visible light would be translucent or transparent despite the fact that the material may block ultraviolet light. Transparent should be interpreted as allowing for the transmission of visible light with little scattering (e.g., window glass). Translucent should be interpreted as allowing for the transmission of visible light with some scattering (e.g., frosted glass) or without scattering. Thus, any material that allows for the passage of visible light is transparent, translucent, or both with transparent being a subset of translucent.

Figure 2:
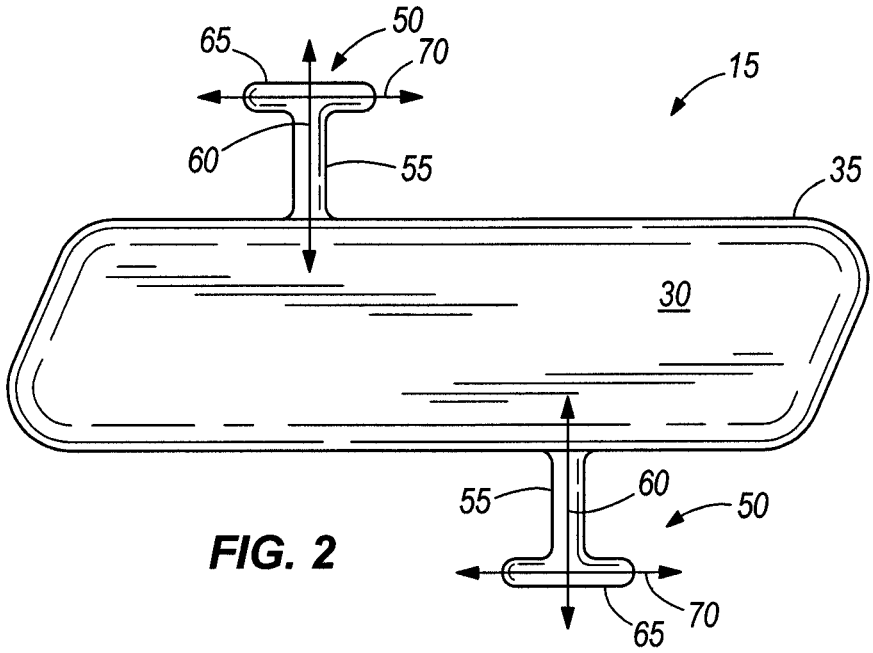
FIG. 2 is a top view of the pushbutton of FIG. 1.
Figure 3:
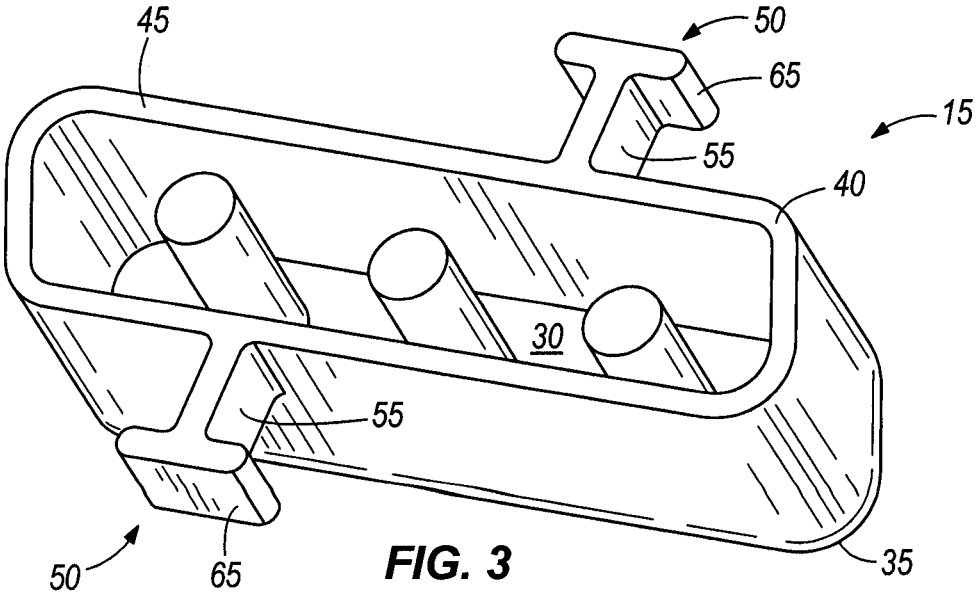
FIG. 3 is a bottom perspective view of the pushbutton of FIG. 1.

As illustrated in FIGS. 2 and 3, the pushbutton 15 includes a top wall 30 that defines a pushbutton perimeter 35. A pushbutton wall 40 extends around the pushbutton perimeter 35 and separates a pushbutton interior and exterior. The pushbutton wall 40 extends away from the top wall 30 in a substantially normal direction and terminates at a bottom surface 45. In preferred constructions, the top wall 30 and the pushbutton wall 40 are formed as a single component from a unitary material such as plastic. In some constructions, the material used is opaque, while other constructions may employ a translucent or transparent material.

Figure 2A:
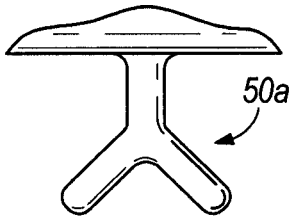
FIG. 2*a* is a bottom view of another rib suitable for use with the pushbutton of FIG. 2.
Figure 2B:
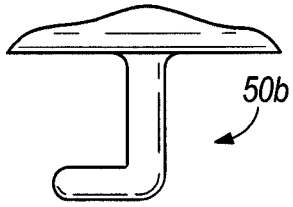
FIG. 2*b* is a bottom view of another rib suitable for use with the pushbutton of FIG. 2.
Figure 2C:
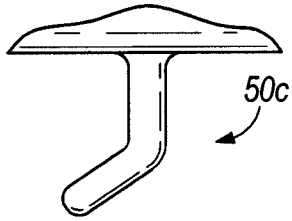
FIG. 2*c* is a bottom view of another rib suitable for use with the pushbutton of FIG. 2.

Two ribs 50 extend from the pushbutton wall 40 into the exterior defined by the pushbutton wall 40. The ribs 50 extend along the pushbutton wall 40 from the bottom surface 45 toward the top wall 30 but terminate before the top wall 30 to define a rib height. Each rib 50 includes a first guide 55 that extends in a first direction 60 and a second guide 65 that extends in a second direction 70 that is not parallel to the first direction 60. In the illustrated construction, the second guide 65 is positioned at an end of the first guide 55 to define a T-shaped rib 50. In other constructions, the second direction 70 is oblique with respect to the first direction 60 such that the rib is Y-shaped 50*a* as illustrated in FIG. 2*a*. In still other constructions, one of the legs of the second guide 65 can be omitted to define an L-shaped rib 50*b* as illustrated in FIG. 2*b* or a boomerang shape rib 50*c* as illustrated in FIG. 2*c*. As one of ordinary skill in the art will realize, many other shaped ribs 50 are possible. For example, another construction includes a first guide 55 as illustrated in FIG. 2 with a cylindrical or circular second guide disposed at the end of the first guide 55. In still other constructions, the second guide 65 is between the ends of the first guide 55 such that the rib is a cruciform. Thus, the invention should not be limited to the arrangements illustrated and discussed herein or combinations of the arrangements discussed herein.

In preferred constructions, the ribs 50 are formed as one piece with the pushbutton wall 40 and the top wall 30. In addition, for improved performance it is preferable that the first guide 55 of each of the ribs 50 not be coplanar and that the second guide 65 of each of the ribs 50 not be coplanar. In addition, more or fewer than two ribs 50 could be employed if desired.

Figure 5:
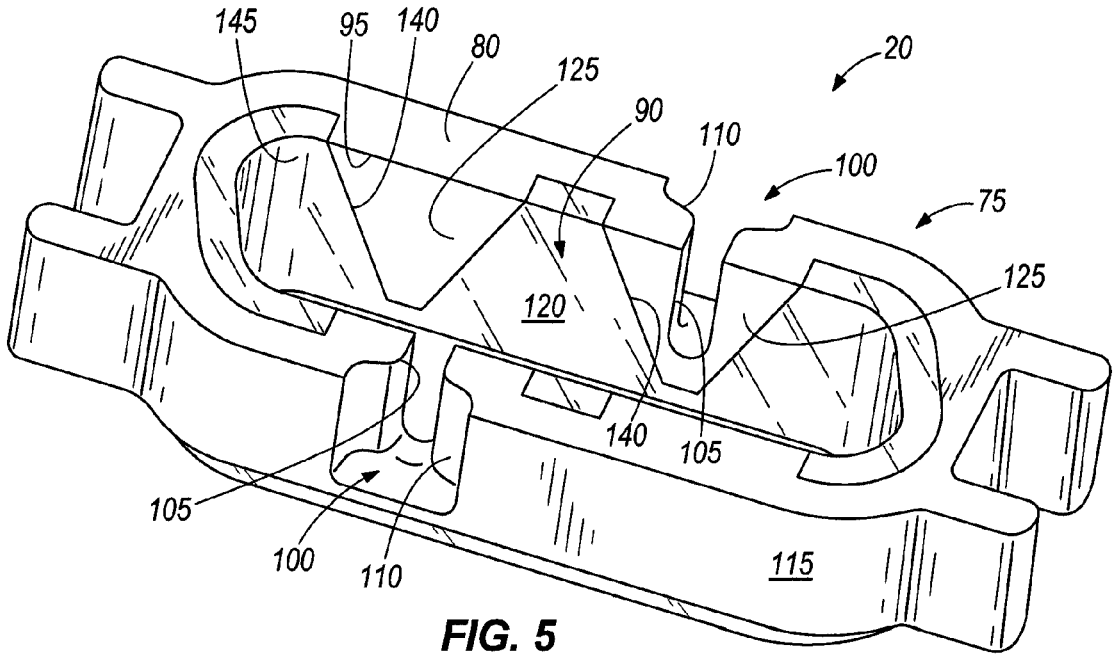
FIG. 5 is a bottom perspective view of the carrier of FIG. 1.
Figure 6:
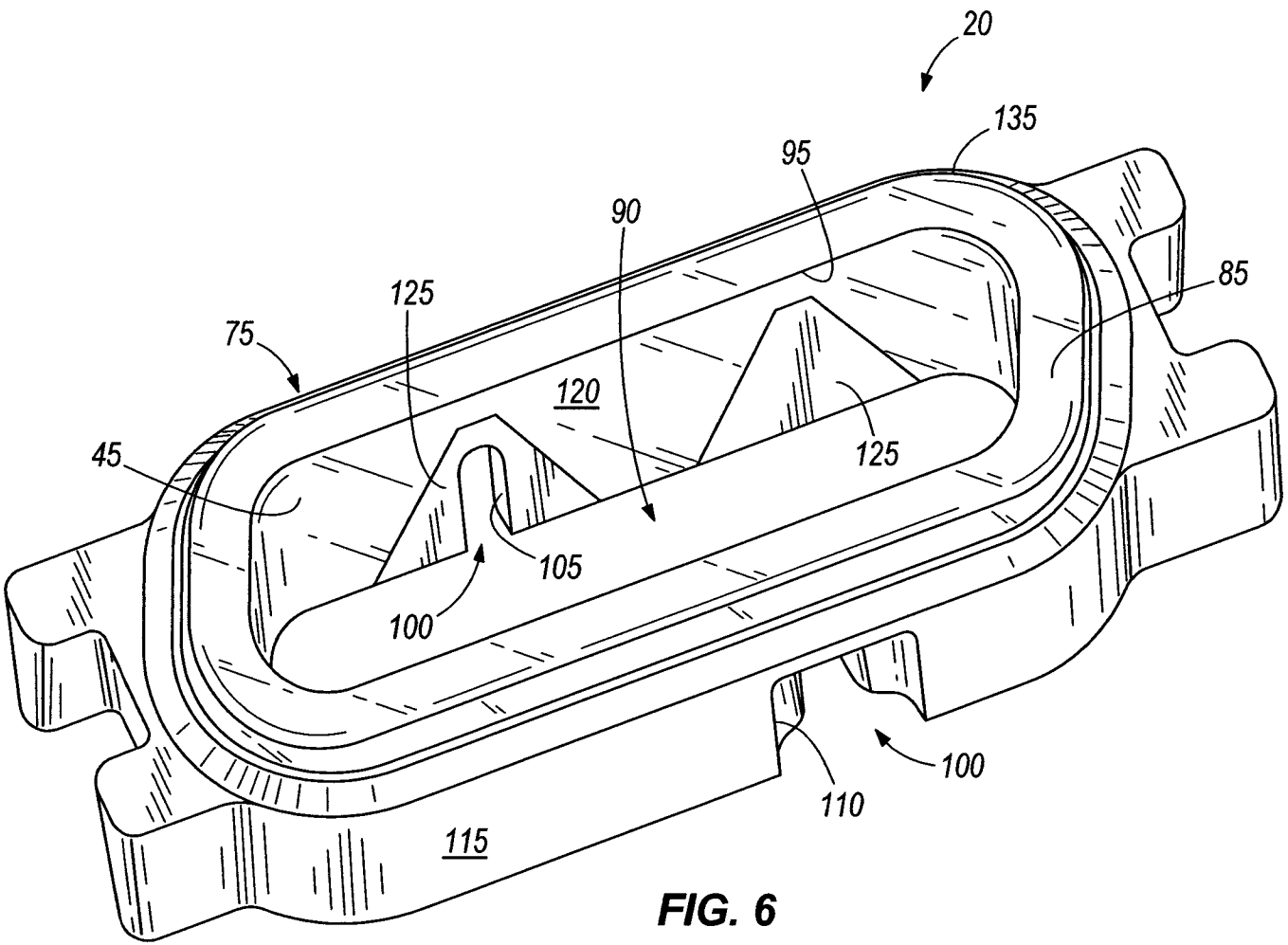
FIG. 6 is a top perspective view of the carrier of FIG. 5.

The carrier 20, illustrated in FIGS. 5 and 6 includes an outer wall 75 that defines a bottom surface 80, a top surface 85, and an inner space 90. The outer wall 75 includes an inner perimeter 95 that surrounds the inner space 90 and closely matches the pushbutton perimeter 35. Two rib guides 100 are formed in the outer wall 75 and extend from the bottom surface 80 toward the top surface 85 but do not extend through the top surface 85. Each rib guide 100 includes a first portion 105 that extends in the first direction 60 and a second portion 110 that extends in the second direction 70. As will be understood by one of ordinary skill in the art, the arrangement of each of the rib guides 100 is largely dictated by the arrangement of the rib 50.

The outer wall 75 includes an outer portion 115 and a light guide 120 that are closely connected to one another. The outer portion 115 is preferably formed from an opaque material that defines the outermost portion of the carrier 20 and includes one or more protrusions 125 near the inner space 90. In the illustrated construction, the protrusions 125 are frustoconical with the large end of the cone forming part of the bottom 80 of the carrier 20 and the small end of the cone disposed near the top surface 85 of the carrier 20. Each of the rib guides 100 extends through one of the frustoconical protrusions 125. In other constructions, the protrusions 125 may be other shapes as desired.

The light guide 120, best illustrated in FIG. 6 is formed from a transparent or translucent material and includes the top surface 85 that defines a substantially continuous perimeter 135. The light guide 120 includes a plurality of gaps 140 that are sized and shaped to receive the protrusions 125. An inner surface 145 of the light guide 120 and the inner surfaces of the protrusions 125 cooperate to define the perimeter 95 of the inner space 90 which is sized to receive the pushbutton wall 40. In a preferred construction, the light guide 120 is bonded to the outer portion 115 to complete the outer wall 75.

Figure 4:
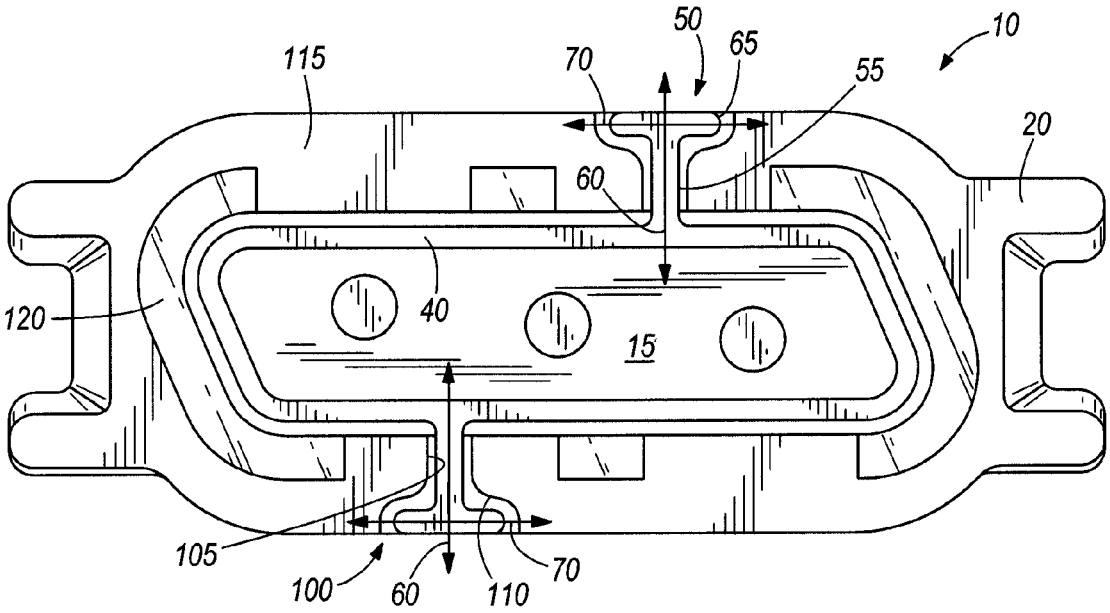
FIG. 4 is a bottom view of the lighted pushbutton disposed within the carrier of FIG. 1.

With reference to FIGS. 1 and 4, the assembly and operation of the lighted pushbutton assembly 10 will now be described. As shown in FIG. 4, the pushbutton 15 fits within the inner space 90 of the carrier 20 such that the perimeter 95 of the inner space 90 and the pushbutton wall 40 are disposed close to one another. Each of the ribs 50 is disposed within one of the rib guides 100 such that the first guide 55 fits within the first portion 105 and the second guide 65 fits within the second portion 110. The height of the ribs 50 and the rib guides 100 are such that movement of the pushbutton 15 in an upward direction (i.e., toward the top surface 85 of the carrier 20) is limited by contact between the ribs 50 and the outer wall 75, while movement in the opposite direction is not inhibited. In addition, the ribs 50 and rib guides 100 cooperate to inhibit movement of the pushbutton 15 in the first direction 60 and the second direction 70. The positioning of the ribs 50 also assists in inhibiting twisting of the pushbutton 15 that could cause binding or inaccurate movement within the carrier 20.

In operation, the carrier 20 and pushbutton 15 are assembled as illustrated in FIGS. 1 and 4 and positioned above the light source 25 as illustrated in FIG. 1. In preferred arrangements, the light source 25 is completely enclosed and surrounded by components not illustrated herein. The light is emitted by the light source 25 and enters the light guide 120 at the bottom surface 80 of the carrier 20. The light is free to travel through the light guide 120 and is ultimately emitted through the top surface 85. As illustrated in FIG. 1, the top surface 85 extends completely around the pushbutton 15 such that the emitted light completely surrounds the pushbutton 15 and is uninterrupted by the ribs 50 or any other features. In some constructions, surfaces of the light guide 120 that undesirably emit light are covered or coated with an opaque material to enhance the amount of light emitted through the desired top surface 130. In addition, the pushbutton 15 can be formed from a transparent or translucent material to allow the light source 25 to light the pushbutton 15 as well as the top surface 130 of the light guide 120. Different colors or materials of different opacity could be employed to provide the desired lighting effect.

To operate the pushbutton 15, the user simply pushes on the top wall 30 of the pushbutton 15. The pushbutton 15 moves downward within the carrier 20 and the ribs 50 and rib guides 100 cooperate to assure that the pushbutton 15 moves without twisting or binding. A biasing member (not shown) is typically positioned behind the pushbutton 15 to bias it toward the position illustrated in FIG. 1. The lighting effect could be controlled by various parameters such that the top surface 85 of the carrier 20 is illuminated whenever the component is operating, is illuminated only when the pushbutton 15 should be pushed, or is illuminated when the pushbutton 15 is actuated. In addition, the color or level of illumination could be varied to provide the desired effect.

Thus, the invention provides, among other things, a lighted pushbutton assembly 10 that uses a light guide 120 and a unique rib arrangement to light the perimeter around the pushbutton 15 and to guide the movement of the pushbutton 15.

What is claimed is:

1. A lighted pushbutton assembly configured to be lighted by a light source, the lighted pushbutton assembly comprising:

a carrier including an outer wall that defines an inner space, the outer wall being continuous along a top surface of the carrier;

a rib guide formed as part of the outer wall, the rib guide defining an opening that extends through a bottom surface of the outer wall and includes a first portion that extends in a first direction and a second portion that extends in a second direction, the second direction being non-parallel to the first direction;

a pushbutton shaped to fit substantially within the inner space; and a rib formed as part of the pushbutton and including a first guide that extends in the first direction and a second guide that extends in the second direction, the first guide engaged with the first portion and the second guide engaged with the second portion to guide reciprocating movement of the pushbutton with respect to the carrier.

2. The lighted pushbutton assembly of claim 1, wherein the outer wall includes an outer portion formed from a substantially opaque material, the carrier further comprising a light guide positioned within the outer portion and formed from a substantially translucent material.

3. The lighted pushbutton assembly of claim 2, wherein the light guide defines a top surface that includes a substantially continuous perimeter, the light guide including a plurality of gaps, and wherein the rib guide is formed within one of the plurality of gaps.

4. The lighted pushbutton assembly of claim 3, wherein the pushbutton and carrier are disposed above the light source such that light enters the light guide at the bottom surface and is emitted through the continuous perimeter of the top surface.

5. The lighted pushbutton assembly of claim 1, wherein the second direction is substantially normal to the first direction and the rib is one of L-shaped and T-shaped.

6. The lighted pushbutton assembly of claim 1, wherein the second direction is oblique to the first direction and the rib is substantially Y-shaped.

7. The lighted pushbutton assembly of claim 1, wherein the rib guide is the first of a plurality of rib guides and the rib is the first of a plurality of ribs.

8. The lighted pushbutton assembly of claim 7, wherein each of the plurality of ribs is disposed within one of the plurality of rib guides to guide reciprocating movement of the pushbutton with respect to the carrier.

9. A lighted pushbutton assembly configured to be lighted by a light source, the lighted pushbutton assembly comprising:

a carrier including an outer wall having an outer portion formed from a substantially opaque material, the outer wall defining a bottom surface, an inner space and a rib guide that extends through a portion of the outer wall;

a light guide positioned within the outer portion and formed from a substantially translucent material, the light guide defining a top surface that includes a substantially continuous perimeter and a plurality of gaps, a guide space being positioned within one of the plurality of gaps; and a pushbutton disposed within the inner space and having a pushbutton outer perimeter that is surrounded by the top surface of the light guide, the pushbutton and carrier disposed above the light source such that light enters the light guide at the bottom surface and is emitted through the top surface and around the entire pushbutton perimeter.

10. The lighted pushbutton assembly of claim 9, wherein the light guide is bonded to the outer wall.

11. The lighted pushbutton assembly of claim 9, wherein the rib guide includes a first portion that extends in a first direction and a second portion that extends in a second direction that is not parallel to the first direction.

12. The lighted pushbutton assembly of claim 11, further comprising a rib formed as part of the pushbutton and including a first guide that extends in the first direction and a second guide that extends in the second direction.

13. The lighted pushbutton assembly of claim 12, wherein the first guide engages the first portion and the second guide engages the second portion to guide reciprocating movement of the pushbutton with respect to the carrier.

14. The lighted pushbutton assembly of claim 9, further comprising a rib formed as part of the pushbutton, the rib disposed substantially within the rib guide to guide reciprocating movement of the pushbutton with respect to the carrier.

15. The lighted pushbutton assembly of claim 14, wherein the rib is one of L-shaped, T-shaped, and Y-shaped.

16. The lighted pushbutton assembly of claim 14, wherein the rib guide is the first of a plurality of rib guides and the rib is the first of a plurality of ribs, and wherein each of the plurality of ribs is disposed within one of the plurality of rib guides to guide reciprocating movement of the pushbutton with respect to the carrier.

17. A lighted pushbutton assembly configured to be lighted by a light source, the lighted pushbutton assembly comprising:

a pushbutton including a top wall arranged to be pushed by a user, the top wall defining a pushbutton perimeter;

a pushbutton wall formed as part of the top wall and extending in a direction substantially normal to the top wall and around the pushbutton perimeter, the pushbutton wall defining a pushbutton exterior, a pushbutton interior, and a bottom surface;

a rib formed as part of the pushbutton wall and extending into the pushbutton exterior, the rib including a first guide that extends from the pushbutton wall in a first direction and a second guide that extends from the first guide in a second direction that is not parallel to the first direction; and a carrier including an outer wall that defines an inner space sized to receive the pushbutton, the outer wall defining a rib guide arranged to receive the rib, the rib guide operable to guide movement of the pushbutton in a direction that is substantially parallel to the pushbutton wall while inhibiting movement in the first direction and the second direction.

18. The lighted pushbutton assembly of claim 17, wherein the first direction is substantially normal to the second direction and the rib is one of L-shaped and T-shaped.

19. The lighted pushbutton assembly of claim 17, wherein the first direction is oblique to the second direction and the rib is substantially Y-shaped.

20. The lighted pushbutton assembly of claim 1, wherein the rib guide is the first of a plurality of rib guides and the rib is the first of a plurality of ribs.

21. The lighted pushbutton assembly of claim 20, wherein each of the plurality of ribs is disposed within one of the plurality of rib guides to guide reciprocating movement of the pushbutton with respect to the carrier.

22. The lighted pushbutton assembly of claim 17, wherein the outer wall includes an outer portion formed from a substantially opaque material and a light guide positioned within the outer wall and formed from a substantially translucent material.

23. The lighted pushbutton assembly of claim 22, wherein the light guide defines a top surface that includes a substantially continuous perimeter and a bottom surface with a plurality of gaps, and wherein the rib guide is formed within one of the plurality of gaps.

24. The lighted pushbutton assembly of claim 23, wherein the pushbutton and carrier are disposed above the light source such that light enters the light guide and is emitted through the continuous perimeter of the top surface.

* * * * *